US006568039B1

(12) United States Patent
Steinert

(10) Patent No.: US 6,568,039 B1
(45) Date of Patent: May 27, 2003

(54) SLIVER CHANNEL WITH REDUCED FRICTION

(75) Inventor: Thomas Steinert, Kerpen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/242,789

(22) Filed: Sep. 13, 2002

Related U.S. Application Data

(63) Continuation of application No. 10/165,792, filed on Jun. 10, 2002.

(51) Int. Cl.[7] ..... D04H 11/00
(52) U.S. Cl. ..... 19/159 R; 19/150; 19/157
(58) Field of Search ..... 19/159 R, 159 A, 19/150, 157, 65 A, 65 R, 105, 98, 236; 57/403; 100/82, 83, 84; 28/289; 226/97.1, 97.2, 97.3, 97.4; 406/86

(56) References Cited

U.S. PATENT DOCUMENTS

| | | | | | |
|---|---|---|---|---|---|
| 2,971,683 | A | | 2/1961 | Paulsen | |
| 3,387,756 | A | | 6/1968 | Goodner | |
| 3,977,045 | A | * | 8/1976 | Saurenman | 19/159 R |
| 4,318,206 | A | * | 3/1982 | Ferri et al. | 19/159 R |
| 4,905,352 | A | * | 3/1990 | Gunkinger et al. | 19/159 R |
| 5,287,598 | A | * | 2/1994 | Gunter et al. | 19/159 R |
| 5,317,786 | A | * | 6/1994 | Oexler et al. | 19/159 R |

FOREIGN PATENT DOCUMENTS

| | | |
|---|---|---|
| CH | 639 628 A5 | 11/1983 |
| DE | 1 925 736 | 10/1965 |
| DE | 1 209 030 | 7/1966 |
| DE | 75 10 100 | 3/1975 |
| DE | 28 14 382 B2 | 10/1978 |
| DE | 27 21 422 A1 | 11/1978 |
| DE | 91 11 665.1 U1 | 3/1992 |
| DE | 41 31 134 A1 | 6/1993 |
| GB | 878752 | 10/1961 |

* cited by examiner

*Primary Examiner*—Gary L Welch
(74) *Attorney, Agent, or Firm*—Venable LLP; Robert Kinberg; Stuart I. Smith

(57) ABSTRACT

A coiler plate is provided for sliver coil depositing. The coiler plate has a rotational axis, a spatially curved sliver channel having a wall, an inside wall surface, a sliver inlet, a sliver outlet, and a plurality of air inlets in the sliver channel wall for introducing air into the sliver channel. The sliver inlet is arranged substantially coaxial with the rotational axis, and the sliver outlet is arranged at a radial distance and an axial distance from the sliver inlet. The sliver is subject to a tensioning draft, and the air introduced into the sliver channel is for acting on the sliver to reduce a frictional force between the sliver and the inside wall surface of the sliver channel.

21 Claims, 4 Drawing Sheets

SLIVER CHANNEL WITH REDUCED FRICTION

CROSS-REFERENCE TO RELATED APPLICATION

This application is a continuation of U.S. patent application Ser. No. 10/165,792, filed Jun. 10, 2002, the disclosure of which is incorporated herein by reference.

BACKGROUND OF THE INVENTION

The invention relates to a device for use with a sliver coiler. More particularly, the invention relates to a coiler plate for sliver coil deposits on, for example, draw frames, carding machines and the like. The coiler plate comprises a spatially curved sliver channel with a sliver inlet and a sliver outlet. The inlet is arranged next to, or coaxial with, the rotational axis and the outlet is arranged at a radial and axial distance from the inlet. The running sliver is subjected to a tensioning draft (force) and movement relative to the inside wall of the sliver channel. A frictional resistance exists between the sliver and the inside wall of the sliver channel.

In practical operations, the sliver in the sliver channel is subjected to multiple movement and force effects. The sliver experiences a certain slacking draft between withdrawing rollers, that pull the sliver after it is formed, and the moving can. A tensile force moves the sliver from the inlet, through the sliver channel, and to the outlet. The outlet is arranged at an axial distance to the inlet, thus causing the sliver to be additionally acted upon by a centrifugal force because of the rotational movement. This force results in a bulging of the sliver path and can lead to an undesirable draft. The centrifugal force is counteracted by reducing the distance between the curved sliver channel and the rotational axis, resulting in the inside wall exerting a counter force onto the sliver and reducing the bulging. The counter force, however, results in increased friction between the sliver material and the inside wall and reduces the sliver movement speed. Thus, undesirable drafts caused by friction cannot be ruled out.

A coiler plate design for delivery speeds of up to 1000 m/min with a curved sliver channel of polished stainless steel has been used. However, a permanent increase in the sliver speed above 1000 m/min was not possible with this design. High frictional forces between the inside wall and sensitive draw frame slivers, in particular, resulted in undesirable drafts.

SUMMARY OF THE INVENTION

Thus, it is an object of the invention to create a coiler plate of the aforementioned type, which avoids the previously mentioned disadvantages and, in particular, results in an improved sliver guidance and sliver quality.

Particular embodiments of the invention provide a coiler plate for sliver coil depositing. The coiler plate has a rotational axis, a spatially curved sliver channel having a wall, an inside wall surface, a sliver inlet, a sliver outlet, and a plurality of air inlets in the sliver channel wall for introducing air into the sliver channel. The sliver inlet is arranged substantially coaxial with the rotational axis, and the sliver outlet is arranged at a radial distance and an axial distance from the sliver inlet. The sliver is subject to a tensioning draft, and the air introduced into the sliver channel is for acting on the sliver to reduce a frictional force between the sliver and the inside wall surface of the sliver channel.

The measures according to the invention take into account the effects of different movements and forces exerted by the sliver and onto the sliver on the inside of the sliver channel. The forces are not effective in the same way at all locations. As a result, undesirable or interfering forces can be countered partially and individually by changing the interaction and/or the spatial correlation between the sliver and the inside wall. In this way, the sliver guidance and the sliver quality can be improved considerably and a substantial increase in the sliver running speed above 1000 m/min can be achieved. These speeds are particularly suitable for draw frames. The improved sliver guidance according to the invention in the same way permits an increase in the sliver quality, even for sliver running speeds below 1000 m/min. These speeds are particularly suitable for carding machines. In particular, the sliver draft is noticeably more uniform in its various sections or regions. The partial drafts and their effects on the sections or regions of the sliver in the sliver channel are more uniform and the tensioning draft is improved on the whole.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
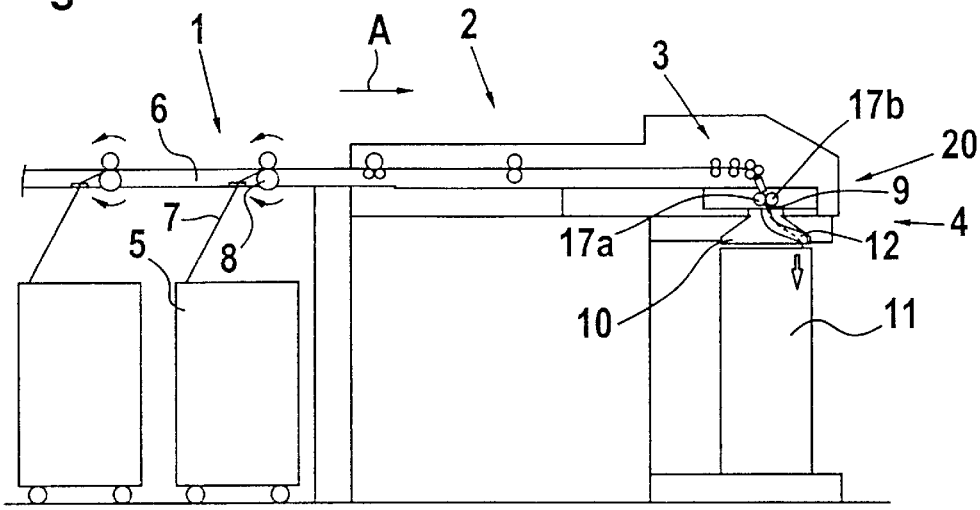
FIG. 1 is a schematic side elevation view of a draw frame with a coiler plate according to the invention.

FIG. 1 shows (partially) the inlet region 1, the measuring region 2, the draw unit 3 and the sliver coil deposit 4 of a draw frame, e.g. a Trützschler Draw Frame Model HSR. In this example, the coiling cans 5 (round cans) of a draw frame are arranged in two can rows in the inlet region 1 beneath the sliver run-in 6 (creel). The feed slivers 7 are pulled off via feed rollers 8 and are supplied to the draw unit 3. After moving through the draw unit 3, the drawn sliver enters a coiler plate 10 of a sliver coil can arrangement 20 and is deposited in the form of rings in an outlet can 11. The coiler plate 10 contains a sliver channel 12, e.g. a curved tube, through which the sliver 9 passes. The arrow A denotes the operating direction of the draw frame while 17*a* and 17*b* represent calender rollers.

Figure 2:
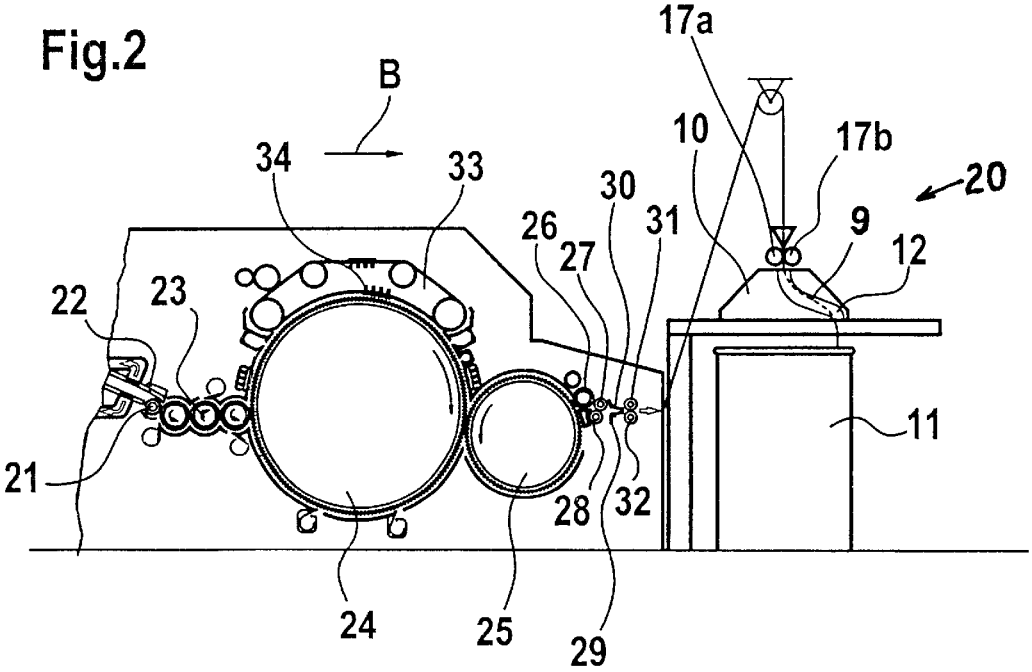
FIG. 2 is a schematic side elevation view of a carding machine with a coiler plate according to the invention.

FIG. 2 shows a carding machine, e.g. a Trutzschler High Performance Carding Machine Model DK 903, having a feed roller 21, feed table 22, licker-ins 23, main carding cylinder 24, doffer 25, stripping roll 26, crushing rolls 27, 28, web-guiding element 29, web trumpet 30, withdrawing rollers 31, 32, travelling flats 33 with flat bars 34, withdrawing rollers 17*a*, 17*b*, can 11 and the sliver coil can arrangement 20. Curved arrows are used to show the direction of rotation for the rollers. The card operating direction is shown by the arrow B. A housing containing a rotating coiler plate 10 is located above the cover plate for the sliver coil can arrangement 20. A drive mechanism (not shown) moves the can 11 while the coiler plate 10 deposits the sliver 9 in the can. The coiler plate 10 contains a sliver channel 12, e.g. a curved tube, through which the sliver 9 passes.

Figure 3A:
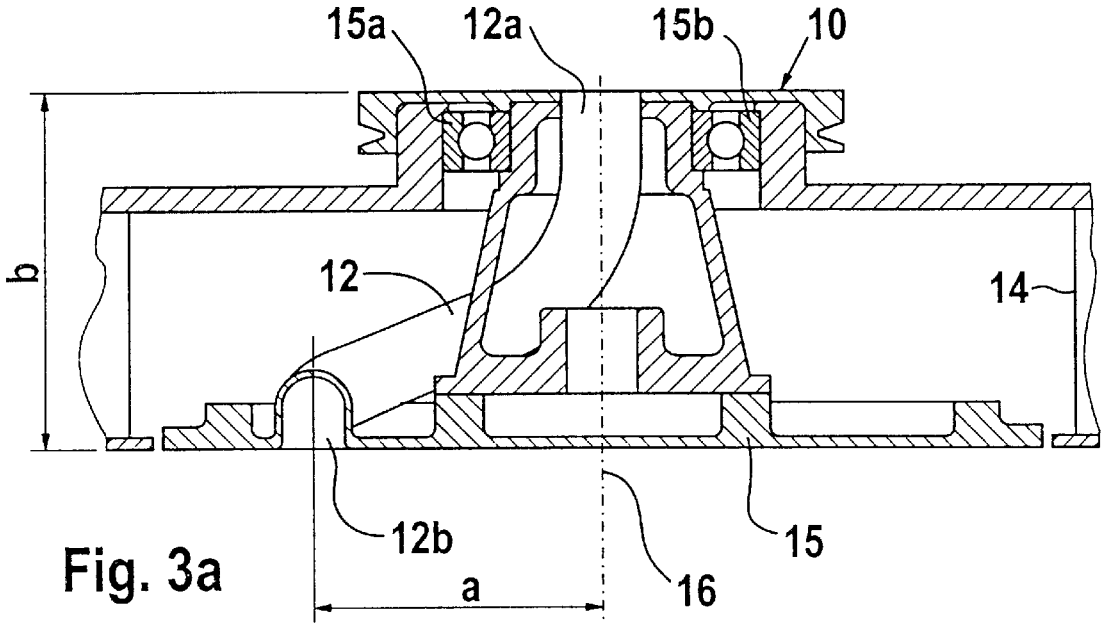
FIG. 3*a* is a sectional view of the coiler plate as shown in FIG. 1.
Figure 3B:
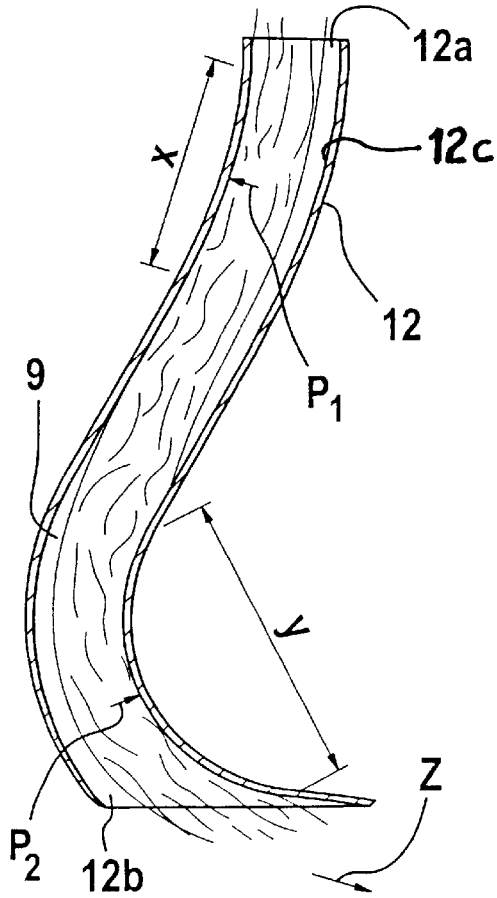
FIG. 3*b* is a sectional view from the side of the sliver channel and sliver.

In the example shown in FIG. 3*a,* the sliver channel 12, for example formed by a bent tube, is spatially curved and is provided with an inlet 12*a* and an outlet 12*b* for the sliver 9 (see FIG. 3*b*). In this example, the inlet 12*a* is arranged coaxial to the rotational axis 16 and the outlet 12*b* is arranged at a radial distance a, as well as an axial distance b, from the inlet 12*a*. The coiler plate 10 is arranged in an opening of the locally fixed plate 14. The sliver inlet opening can be flared or have a cross sectional area greater than a cross sectional area of a central portion of the sliver channel. The sliver outlet opening 12*b,* which is located in the coiler plate 10, can have an elliptical shape. The sliver 9 moves through the sliver channel 12 and exits through the sliver outlet opening 12*b* into the can 11 (see FIG. 1). The reference numbers 15*a,* 15*b* refer to ball bearings.

Inside the sliver channel 12, the sliver 9 is subjected to a slight tensioning draft, designated as tensioning force Z shown in FIG. 3*b*. While passing through, the sliver 9 follows the bends in the sliver channel 12. As a result of these bends and the tensioning force Z, the sliver 9 exerts frictional forces $P_1$ and $P_2$ in the regions x and y onto the inside wall 12*c* of the sliver channel. Frictional forces $P_1$ and $P_2$ are larger than frictional forces present in the remaining areas of the inside wall 12*c*. A relative movement exists between the running sliver and the inside wall 12*c*.

Figure 3C:
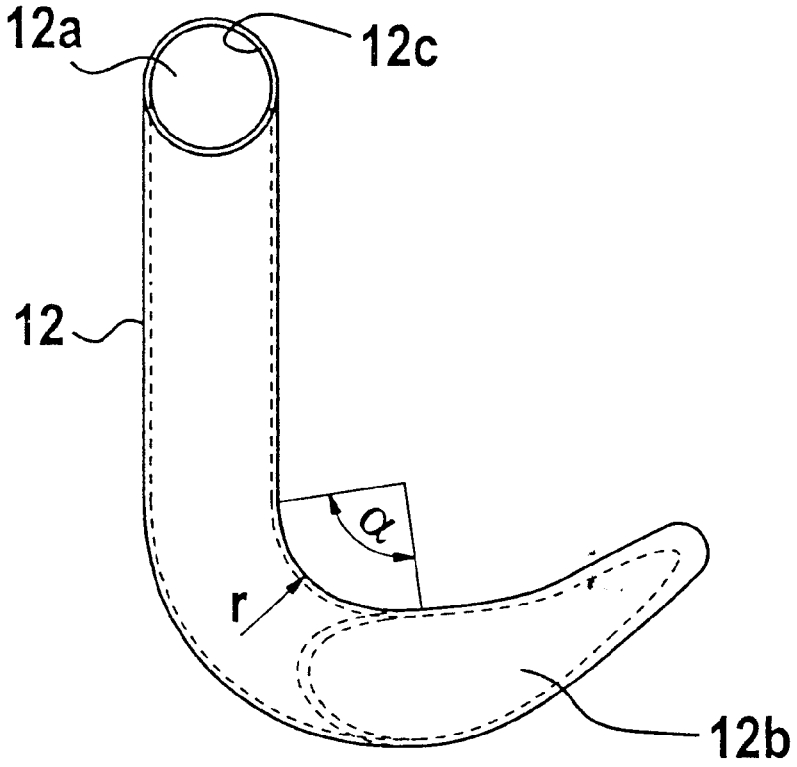
FIG. 3*c* is a top plan view of the sliver channel.

According to the invention, the frictional resistance between sliver 9 and inside wall 12*c* is reduced by changing the interaction and/or the spatial coordination between sliver 9 and inside wall 12*c* of the sliver channel 12. The regions x and y of the inside wall 12*c* in this case are of considerable importance. The friction between sliver 9 and the regions x and y on the inside wall 12*c* can thus be reduced by reducing the friction coefficient $\mu$, by reducing the friction angle $\alpha$ and/or by increasing the curvature radius r (see FIG. 3*c*). The tensioning force Z that is determined by the withdrawing rollers 17*a,* 17*b* and the speed of can 11 can also be changed. These measures, either individually or in combination, can reduce the frictional forces $P_1$ and $P_2$.

The coiler plate 10 deposits the outlet sliver 9 arriving from the sliver-forming machine in a cycloidal manner in the spinning can 11. The cycloidal shape is created by superimposing two rotational movements, a fast movement realized by the coiler plate 10 and a slow movement realized by the can 11 (in the case of the rectangular can, the second (slow) movement is a translational movement). During the deposit, the sliver is subjected to various forces inside the channel 12, such as the force of gravity, centrifugal force, the pre-tensioning force caused by the effective tensioning draft, the frictional force between sliver 9 and the channel inside wall 12*c*. The frictional force is counter to the movement direction of the sliver 9 and thus hinders the discharge operation. To obtain clean operating conditions, the tensioning draft is controlled such that the sliver channel 12 is always subjected to some tension. The sliver thus always fits itself against the convex curved, smaller inside radius of the curved areas in all curved regions of the channel 12. The above-mentioned frictional force essentially is generated by the interaction between sliver 9 and channel 12 in the contact zones x and y. The previously described negative influences on the machine behavior and the sliver quality are primarily determined by this friction between sliver 9 and inside wall 12*c* of the channel 12.

The following measures are implemented either individually or in combination to improve the sliver guidance in the channel 12.

Lowering the amount of friction between the sliver material and the inside surface of the channel can be achieved by coating the channel in sections or producing it with low-friction materials. The tensioning draft can be lowered in this way and the number of undesirable drafts can be reduced.

The geometry of the channel can be changed so that the sliver material is prevented from unwinding across the circumference of the channel 12.

The channel 12 can be expanded, in particular in the inlet area 12*a*. As a result, the contact between channel 12 and the sliver 9 is minimized under the influence of the tensioning.

Forces can be exerted from the outside onto the sliver 9 (e.g. by generating a magnetic or electric field) in order to reduce the friction between the sliver and the channel surface 12*c*.

Fluctuations in the sliver stress caused by the sliver depositing are compensated for with the aid of a controlled drive of, e.g. the can.

A suitable design for the sliver channel can reduce the length over which the sliver is guided.

The sliver channel 12 can have a shape other than round (for example elliptical or polygonal).

The measures for reducing the friction inside the sliver channel can be used, for example, for draw frames, carding machines and roller card units.

Particular embodiments of the invention prevent or reduce the contact forces (in particular $P_1$ and $P_2$) from developing by using a cushion of air to separate the sliver 9 and the tube inside wall 12*c* in, for example, the contact zones x and y. This is achieved by providing perforations and slots in some sections of channel 12. As a result, a flow of air is introduced, which flows from the outside to the inside of tube 12 and pushes the sliver away from the tube inside wall 12*c,* thus reducing the contact force and the frictional force. Relative to the tube wall, the perforations or slots can be formed, for example drilled, at a right angle to the tube wall or at a different angle relative to the tube wall in a sliver movement direction. The air cushion can be created in different ways. For example, the air cushion can be created passively by using the conveying effect of the centrifugal force that is effective inside the rotating tube 12 or by using existing pressure differences. Alternatively, or in addition to passive air cushion creation, the air cushion can be created actively by blowing air in from outside of the tube.

On the one hand, a flow of air must be generated that is strong enough to create an effective separation of sliver 9 and tube wall 12*c*. On the other hand, the flow of air should not cause splicing through reorientation of sliver fibers to non-parallel positions, which can result in a reduced capability of being spun. Such splicing is prevented through suitable positioning, dimensioning and orientation of the openings in the tube wall as well as through correctly gauging the amount of air used.

Figure 4:
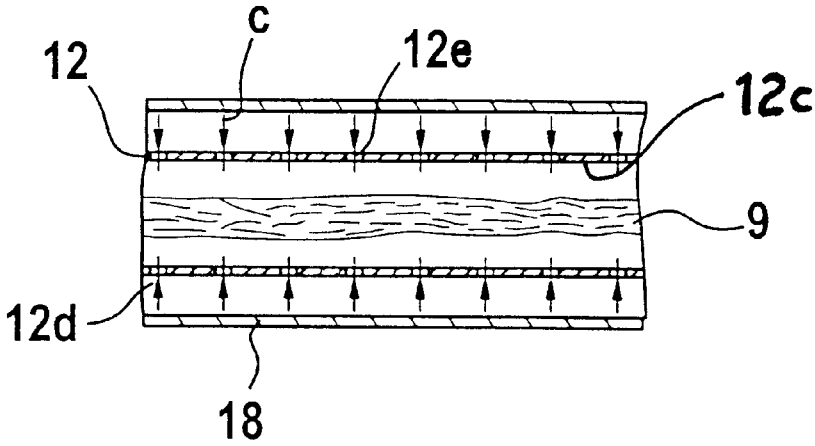
FIG. 4 is a sectional view through a sliver channel with air-intake openings.

In the example shown in FIG. 4, the sliver channel 12 is provided with openings 12*e*. A closed tube 18 is arranged around the outside surface 12*d* of the sliver channel 12, to which a compressed-air source (not shown herein) is connected. Compressed-air flows c flow from the inside of tube 18 through the openings 12*e* and into the inside space of sliver channel 12, thus pushing the sliver 9 away from the inside wall 12*c*.

Figure 5:
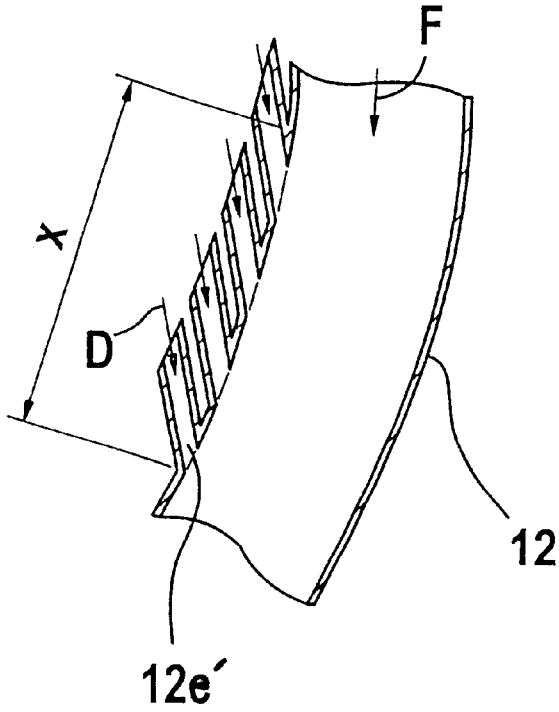
FIG. 5 shows a partial sectional view of sliver channel air-intake openings slanted in a sliver running direction according to a modified embodiment of the invention.

In the example shown in FIG. 5, the compressed-air flows D enter the inside space of sliver channel 12 at an angle relative to the sliver movement direction F and thus support the sliver movement. The openings 12*e*' are preferably arranged only in the regions of highest friction, e.g. in regions x and y.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A coiler plate for sliver coil depositing, the coiler plate having a rotational axis and comprising:

a spatially curved sliver channel having a wall, an inside wall surface, a sliver inlet and a sliver outlet, the sliver inlet being arranged substantially coaxial with the rotational axis, the sliver outlet being arranged at a radial distance and an axial distance from the sliver inlet, and a plurality of air inlets in the sliver channel wall for introducing air into the sliver channel, wherein the sliver is subject to a tensioning draft, and the air introduced into the sliver channel is for acting on the sliver to reduce a frictional force between the sliver and the inside wall surface of the sliver channel.

2. The coiler plate according to claim 1, wherein the air inlets are positioned in particular locations in the sliver channel wall for reducing the frictional force at the particular locations.

3. The coiler plate according to claim 2, wherein a portion of the sliver channel inside wall surface is convex toward a sliver running path, and the air inlets are positioned for reducing the frictional force at the convex portion of the sliver channel.

4. The coiler plate according to claim 1, wherein a portion of the inside wall surface comprises a low friction material.

5. The coiler plate according to claim 4, wherein the low friction material comprises a coating.

6. The coiler plate according to claim 5, wherein the entire inside wall surface comprises a low friction material.

7. The coiler plate according to claim 1, wherein the spatial curve of the sliver channel approximates a curve defined by an unconstrained sliver spun about its central axis.

8. The coiler plate according to claim 1, wherein the sliver inlet has a cross sectional area greater than a cross sectional area of a central portion of the sliver channel.

9. The coiler plate according to claim 1, wherein a portion of the sliver channel is circular in cross section.

10. The coiler plate according to claim 1, wherein a portion of the sliver channel is elliptical in cross section.

11. The coiler plate according to claim 1, wherein a portion of the sliver channel is polygonal in cross section.

12. The coiler plate according to claim 1, wherein the sliver outlet has an elliptical cross section.

13. The coiler plate according to claim 1, further comprising an outer tube positioned around the sliver channel.

14. The coiler plate according to claim 13, wherein the outer tube and the sliver channel are coaxial.

15. The coiler plate according to claim 1, wherein the air inlets are shaped such that the air is introduced into the sliver channel in a radial direction.

16. The coiler plate according to claim 1, wherein the air inlets introduce the air such that an air cushion forms between at least a portion of the sliver and the inside wall surface.

17. The coiler plate according to claim 1, wherein the air inlets are shaped such that the air is introduced at an angle other than 90 degrees to an axis of the sliver channel.

18. The coiler plate according to claim 17, wherein the air inlets are shaped such that the air is introduced in a direction of movement of the sliver.

19. The coiler plate according to claim 1, wherein the air is introduced under pressure.

20. A carding machine comprising the coiler plate according to claim 1.

21. A draw frame comprising the coiler plate according to claim 1.

* * * * *